US007275328B1

(12) United States Patent
Rager

(10) Patent No.: US 7,275,328 B1
(45) Date of Patent: Oct. 2, 2007

(54) BOW SIGHT HAVING VERTICAL POSITIONING MECHANISM

(75) Inventor: Christopher A. Rager, Bozeman, MT (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 11/137,116

(22) Filed: May 25, 2005

Related U.S. Application Data

(60) Provisional application No. 60/575,787, filed on May 28, 2004.

(51) Int. Cl.
*F41G 1/467* (2006.01)

(52) U.S. Cl. ..... 33/265

(58) Field of Classification Search ..... 33/265; 124/87

See application file for complete search history.

(56) References Cited

U.S. PATENT DOCUMENTS

| | | | | |
|---|---|---|---|---|
| 761,272 | A | 5/1904 | Wagniere et al. | |
| 2,542,501 | A | 2/1951 | Fredrickson | |
| 2,545,454 | A * | 3/1951 | Fredrickson | 33/265 |
| 2,777,204 | A | 1/1957 | Graves | |
| 2,959,860 | A | 11/1960 | Kowalcyk | |
| 3,013,336 | A | 12/1961 | Pennington | |
| 3,058,221 | A | 10/1962 | McNeel | |
| 3,063,151 | A | 11/1962 | Hanson | |
| 3,284,904 | A * | 11/1966 | Rade | 33/265 |
| 3,355,809 | A * | 12/1967 | Guyton | 33/265 |
| 3,674,002 | A * | 7/1972 | Diamond, Sr. | 124/87 |
| 4,136,461 | A * | 1/1979 | Gasser | 33/265 |
| 4,215,484 | A | 8/1980 | Lauffenburger | |
| 4,449,303 | A | 5/1984 | Larson | |
| 4,535,747 | A | 8/1985 | Kudlacek | |
| 4,541,179 | A | 9/1985 | Closson | |
| 4,562,649 | A | 1/1986 | Ciavarella | |
| 4,584,777 | A | 4/1986 | Saunders | |
| 4,910,874 | A | 3/1990 | Busch | |
| 4,977,678 | A | 12/1990 | Sears | |
| 5,092,052 | A | 3/1992 | Godsey | |
| 5,092,053 | A * | 3/1992 | Roberts | 33/265 |
| 5,103,568 | A | 4/1992 | Canoy | |
| 5,117,804 | A * | 6/1992 | Jorlov | 124/87 |
| 5,367,780 | A | 11/1994 | Savage | |
| 5,465,491 | A | 11/1995 | Thell | |
| 5,579,752 | A | 12/1996 | Nelson et al. | |
| 5,651,185 | A | 7/1997 | Vanderheyden et al. | |
| 5,676,122 | A | 10/1997 | Wiseby et al. | |
| 5,685,081 | A | 11/1997 | Winegar | |
| 5,718,215 | A | 2/1998 | Kenny et al. | 124/87 |
| 5,920,996 | A | 7/1999 | Hurckman et al. | |

(Continued)

OTHER PUBLICATIONS

U.S. Appl. No. 11/137,131, filed May 25, 2005.

*Primary Examiner*—Christopher W Fulton
(74) *Attorney, Agent, or Firm*—Woodard, Emhardt, Moriarty, McNett & Henry LLP

(57) ABSTRACT

A mount for a bow sight which includes a vertical adjust mechanism at a second end which is actuated by a rotation of a shaft extending toward an opposing first end. The mount includes a central support which is configured to mount to a bow. Vertical adjustment of the bow sight is accomplished by rotation of a rear end of a shaft extending from the first end of the mount.

15 Claims, 6 Drawing Sheets

U.S. PATENT DOCUMENTS

| | | | | |
|---|---|---|---|---|
| 5,975,069 | A | 11/1999 | Hamm et al. | |
| 6,026,799 | A | 2/2000 | Wiseby et al. | |
| 6,079,111 | A | 6/2000 | Williams et al. | |
| 6,119,672 | A | 9/2000 | Closson | |
| 6,134,794 | A | 10/2000 | Raukola | |
| 6,418,633 | B1 | 7/2002 | Rager | |
| 6,493,951 | B1 * | 12/2002 | Smith et al. | 33/265 |
| 6,505,407 | B2 | 1/2003 | Savage | |
| 6,609,306 | B2 | 8/2003 | Johnson et al. | 33/265 |
| 6,796,039 | B2 * | 9/2004 | Walbrink | 33/265 |
| 6,823,597 | B2 | 11/2004 | Larson | |
| 2002/0100177 | A1 | 8/2002 | Savage | |
| 2002/0112358 | A1 | 8/2002 | Savage | |

* cited by examiner

BOW SIGHT HAVING VERTICAL POSITIONING MECHANISM

CROSS-REFERENCE TO RELATED APPLICATION

This application claims the benefit of U.S. Provisional Patent Application Ser. No. 60/575,787, filed May 28, 2004, which application is hereby incorporated by reference in its entirety.

TECHNICAL FIELD

This invention relates to archery equipment and more particularly to a positioning mechanism for use with an archery bow sight. In particular, the positioning mechanism of this invention, in conjunction with a bow sight, adjusts the position of the sight point of the bow sight by vertically adjusting the level of the bow sight.

BACKGROUND

Bow sights are used to assist an archer in more accurately aiming at an intended target. Many bow sights have a single sight point, which provides an aiming point for a target at a set distance away. A fixed sight point is generally suitable for aiming at the set distance. Thus, when aiming at targets positioned at other distances, the sight point produces inaccurate results.

To accommodate for various distances, bow sights having multiple sight points are known. See for example, U.S. Pat. Nos. 5,103,568; 5,676,122; and 5,685,081, which show multiple sight points held by horizontal pins, and U.S. Pat. No. 6,418,633, which shows multiple sight points held by vertical pins. Each of these designs is intended to provide a sight point for a set target distance.

An alternate concept to accommodate various distances has been to move the sight point. Moving the sight point to compensate for the distance to the target allows the archer to use a single sight point to aim at multiple target distances. Movement of the sight point is typically easiest accomplished by moving the entire sight, which includes the housing supporting the sight point, typically in a vertical direction.

Various height adjustment mechanisms for allowing a user to vary the position of the bow sight are known. See for example, U.S. Pat. No. 6,505,407, which teaches a sight adjustment mechanism that operates off a pivoting principle to raise and lower the sight, inversely of the position selected by the archer. Height adjustment mechanisms that operate on a direct motion principle to raise and lower the sight are also known; see for example, U.S. Pat. No. 6,609,306, which teaches a mechanism to raise and lower the sight directly related to the position selected by the archer.

SUMMARY

The invention is generally directed to apparatus for positioning a bow sight. Certain embodiments relate to devices for easily adjusting the vertical position of a bow sight.

One inventive aspect of the disclosure relates to an apparatus for adjusting the vertical position of a bow sight, the apparatus having a vertical position control member that is accessible from the back side of a bow. In certain embodiments, the control member allows the vertical position of the sight to be adjusted without the use of a tool.

Another inventive aspect of the present disclosure relates to a bow sight elevation adjustment mechanism including a drive shaft that extends generally in a front to rear orientation when the mechanism is mounted to a bow. In certain embodiments, the shaft is turned about its central axis to drive a gear mechanism. In other embodiments, a knob or other member is secured to a rear end of the shaft to facilitate manually turning the shaft.

A further inventive aspect of the present disclosure relates to a vertical positioning apparatus for a bow sight. The apparatus includes a central support configured for attaching to a bow. A second end of the central support includes a pinion gear connected to a forward end of a sight adjustment shaft. The sight adjustment shaft has a rear end extending toward an opposite first end of the central support. A bow sight mount is mounted to the second end of the central support. The bow sight mount includes a rack which engages the pinion gear. The bow sight mount is movable in a vertical direction and constrained from movement in a horizontal direction with respect to the central support. Rotation of the sight adjustment shaft moves the bow sight mount vertically with respect to the central support.

Still another inventive aspect of the present disclosure relates to a bow sight system including a bow sight having a sighting pin. The bow sight is mounted to a bow sight mount. The system also includes a support with a first end and an opposing second end, the support configured for mounting to a bow. The bow sight mount is mounted to the second end of the support. The bow sight mount includes a rack and the support includes a pinion gear. Rotation of pinion gear will move the bow sight mount and the bow sight vertically with respect to the support. The pinion gear is mounted to a front end of a shaft. A rear end of the shaft extends toward the first end of the support, and rotation of the rear end of the shaft about a longitudinal axis moves the sight mount vertically.

A further inventive aspect of the present disclosure relates to a bow for propelling an arrow. The bow includes a handle with a grip adapted for grasping by an archer. The handle includes an upper arm and a lower arm, an arrow rest and a mount for a bow sight. A bowstring extends between distal ends of the upper and lower arms. A bow sight assembly is mounted to the mount of the handle. The bow sight assembly includes a support connected to the handle, the support having a first end and a second end. A bow sight is movably attached to the second and of the support. The bow sight assembly includes means for moving the bow sight with respect to the support connected to the handle of the bow. A shaft is connected to the means for moving the bow sight. The shaft extends from the means toward the rear end of the support, and the means is actuated by rotation of the shaft about a longitudinal axis.

These, and additional illustrative aspects of the disclosure, are described below.

BRIEF DESCRIPTION OF THE DRAWINGS

The accompanying drawings, which are incorporated in and constitute a part of the description, illustrate examples of several inventive features and together with the detailed description, serve to explain the principles of the disclosure. A brief description of the drawings is as follows.

DETAILED DESCRIPTION

In the following description, reference is made to the accompanying drawings, which form a part hereof, and in which is shown, by way of illustration, specific embodiments in which the inventive aspects may be practiced. It is to be understood that other embodiments may be utilized and structural changes may be made without departing from the scope of the inventive concepts upon which the present disclosure is based.

Figure 1:
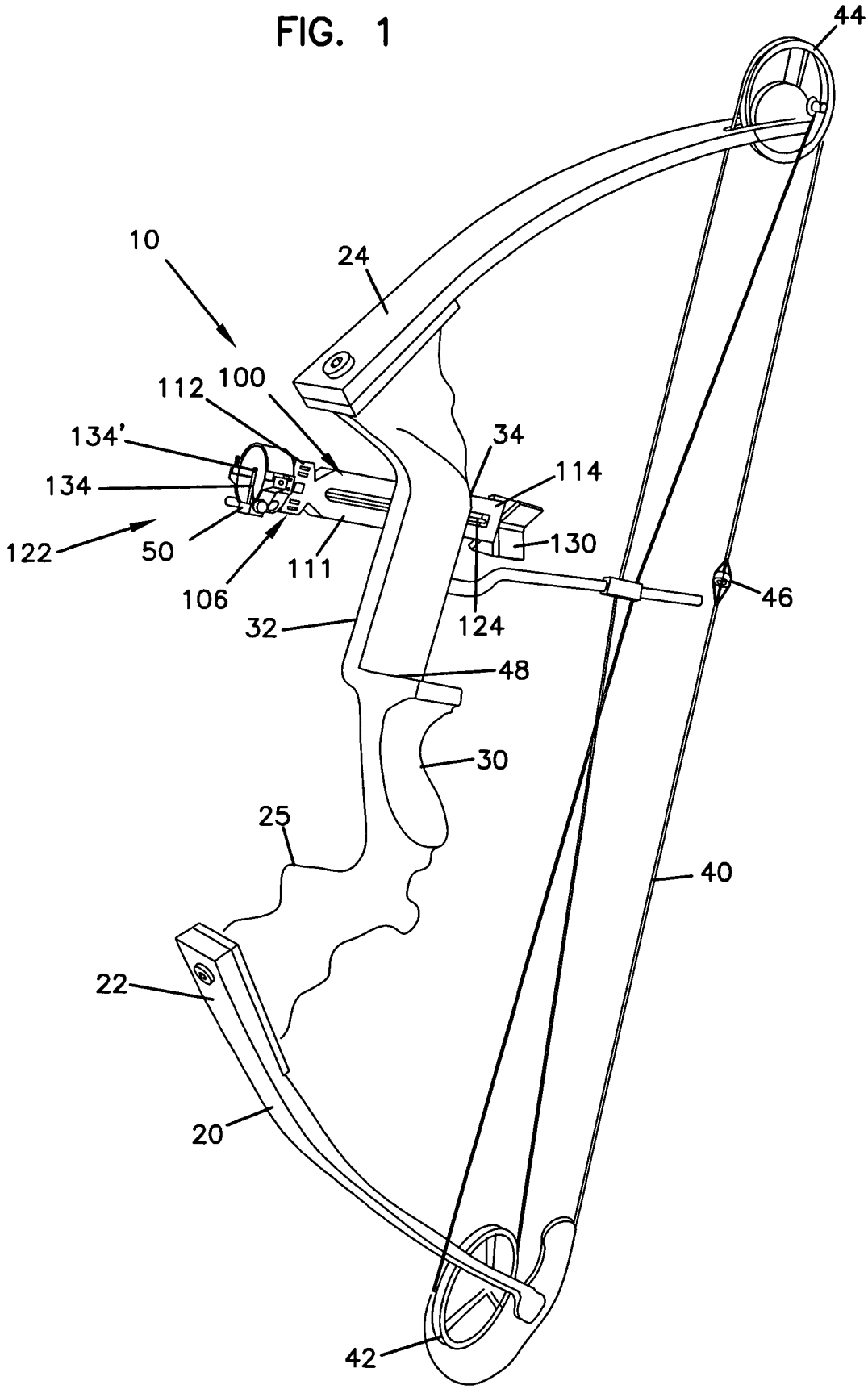
FIG. 1 is a perspective view of a bow incorporating a bow sight assembly with a height adjustment having features that are examples of inventive aspects in accordance with the principles of the present disclosure.

Referring now to the figures, wherein like features are referenced with like numerals, a bow 10 is shown in FIG. 1. Bow 10 includes a frame 20 having a lower portion or arm 22, an upper portion or arm 24, and a handle portion 25 with a grip 30 connected to and supporting lower arm 22 and upper arm 24. The bow 10 has a front surface 32 and an opposite back surface 34. During shooting with the bow, front surface 32 of the bow 10 is positioned facing the target and back surface 34 of the bow 10 is facing the archer. Bow 10 also includes an arrow rest 48 to consistently position an arrow during the process of executing a shot.

Bow 10 includes a string 40 connected to lower arm 22 and upper arm 24. String 40 provides the propulsion of the arrow shot from bow 10.

Bow 10 is illustrated as a compound bow, with pulley or cam 42 at the end of lower arm 22 and pulley or cam 44 at the end of upper arm 24. Bowstring 40 extends between cam 42 and cam 44. Cams 42, 44 provide a mechanical advantage to the archer when drawing bowstring 40. A peep sight 46 is typically positioned on bowstring 40 to facilitate targeting and aiming.

Mounted on handle 25 of bow 10 is a bow sight assembly 122 (schematically shown in FIG. 1) having a bow sight 50. The bow sight 50 includes a sight pin 134 supporting a sight point 134' defined by the end of a light gathering member such as an optical fiber 137 (see FIG. 2). The bow sight assembly 122 also includes a vertical positioning mechanism 100 for vertically adjusting the elevation of the bow sight 50 and its corresponding sight point 134' relative to bow 10. Positioning mechanism 110 has a central support member 111 configured for attachment to bow 10. The central support 111 has a length that extends in a front-to-rear direction relative to the frame 20 of the bow 10. The central support 111 supports a rotational drive shaft 124 that extends in a front-to-rear direction relative to the frame of the bow 10. The shaft 124 is rotated to drive a gear mechanism 106 to preferably provide vertical, non-pivotal height adjustment of the sight 50 relative to the bow. The shaft 124 can be manually rotated about its longitudinal axis with the assistance of an adjustment member such as a finger grip 130 secured to the shaft 124. The finger grip 130 faces in a rearward direction from the bow frame 20 as to be readily accessible from the rear side of the bow frame 20.

The bow sight 50 can be any suitable bow sight for use with archery equipment. As depicted, the sight comprises a pendulum sight having a single vertical sight pin. However, it will be appreciated that non-pendulum sights, horizontal pin sights, multiple pins (as disclosed in U.S. Pat. No. 6,418,633, which is hereby incorporated by reference) or any other type of sight for aiming at a target, could also be used. Example sights can include lighted sight points such as fiber optic sight points, painted sight points, or sight points defined by the end of a sight pin or other structure. Further details concerning the depicted sight 50 can be found in U.S. patent application Ser. No. 11/137,131, entitled Pendulum Bow Sight Having A Vertical Pin, and being filed on a date concurrent with this application.

Figure 2:
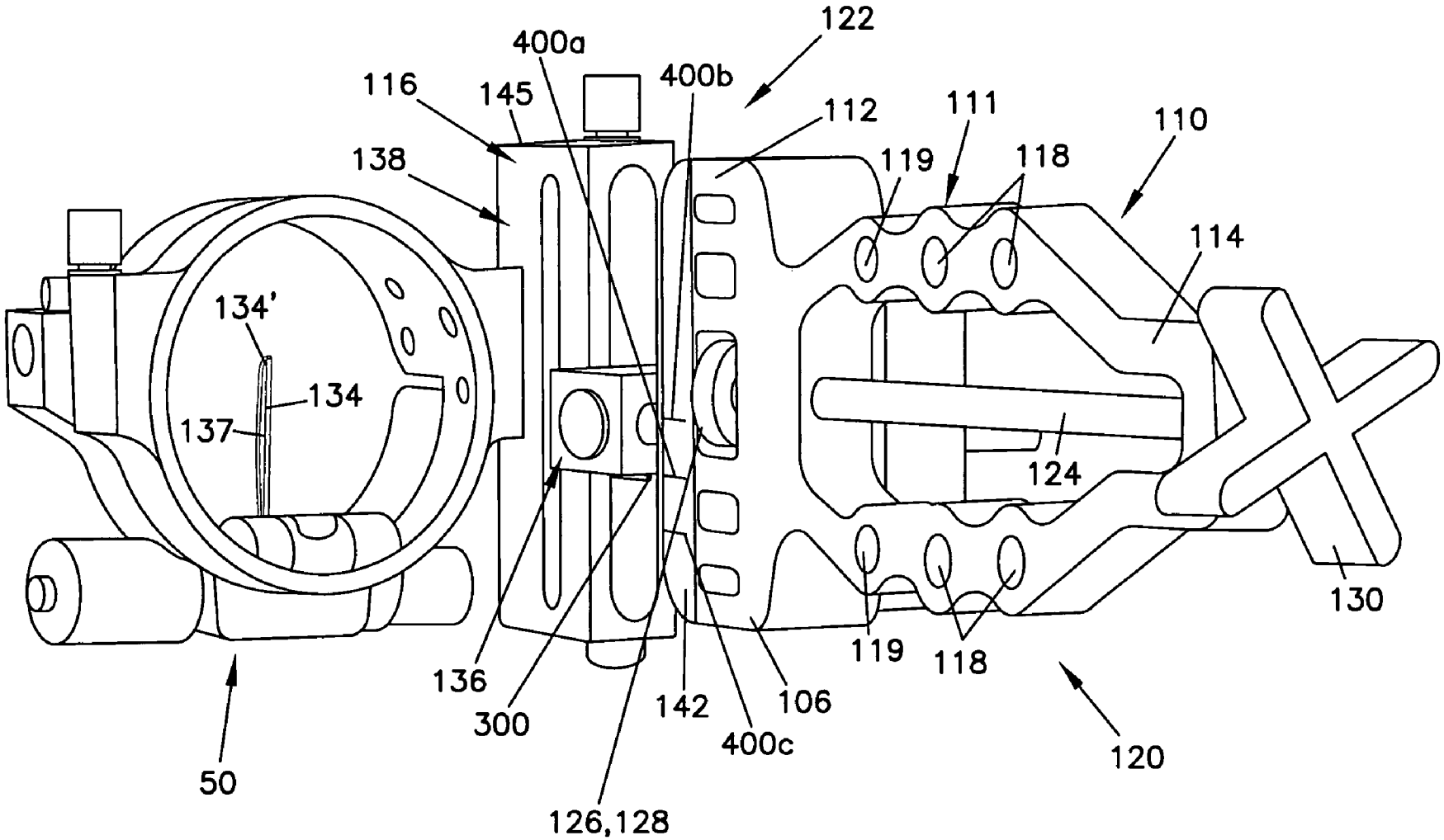
FIG. 2 is a perspective view of the bow sight assembly of FIG. 1 in isolation from the bow.

Referring now to FIG. 2, a detailed perspective view of the bow sight assembly 122 is shown in isolation from the bow 10. As shown in FIG. 2, the central support 111 of the positioning mechanism 110 includes a first end 112 and a second end 114. Extending through central support 111 is a plurality of openings 118 for receiving fasteners to mount sight assembly 122 to bow 10. Openings 118 are shown located between first end 112 and second end 114 but may be positioned adjacent either end as appropriate for the particular bow to which a particular sight may be mounted. Support 111 may also include a pair of openings 119 for mounting accessories to bow sight assembly 122 and/or to bow 10.

Figure 5:
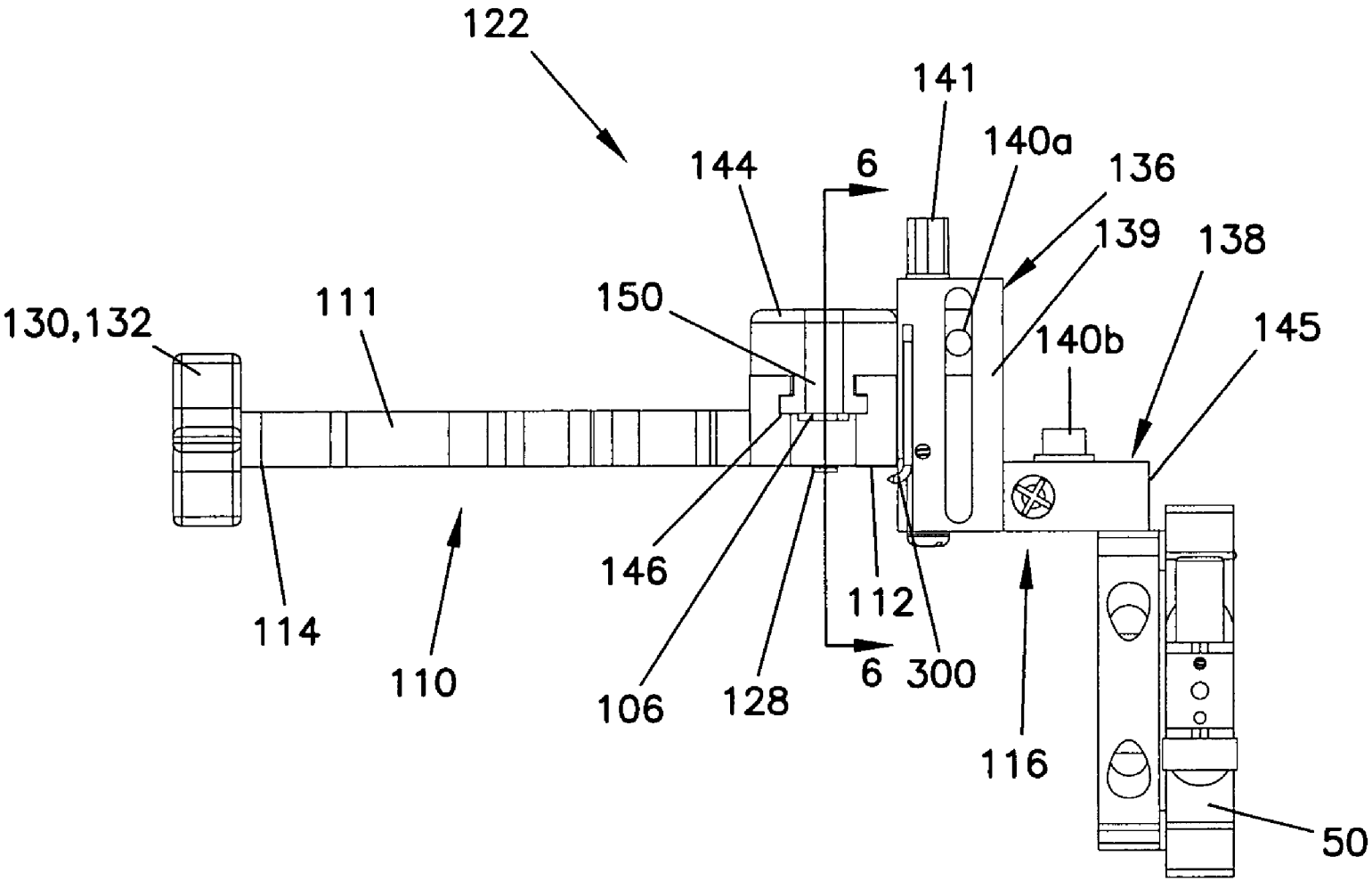
FIG. 5 is a bottom view of the bow sight assembly of FIG. 2.

Referring to FIG. 5, the bow sight assembly 122 includes a bow sight mount 116 that mechanically couples the central support 111 to the bow sight 50. The bow sight mount 116 includes a carriage member 144 that is slidably connected to the first end 112 of the central support 111. The gear arrangement 106 provides a mechanical drive interface between the central support 111 and the carriage member 144 for driving the carriage member 144 vertically up or down relative to the central support 111. By adjusting the vertical position of the carriage member 144 relative to the support 111, the elevation of the bow sight 50 can be vertically adjusted to correspond to different target distances. The bow sight mount 116 also includes a horizontal adjustment arrangement 136 connected to the carriage member 144 for horizontally/laterally adjusting the position of the bow sight 50 relative to the central support 111 to account for windage. The bow sight mount 116 further includes a height adjustment arrangement 138 that connects the horizontal adjustment arrangement 136 to the sight 50. The height adjustment arrangement 138 allows the height of the sight 50 to be adjusted relative to the carriage member 144 to "zero-in" the bow sight assembly 122.

The horizontal adjustment arrangement 136 includes a horizontal adjustment block 139 mounted to slide horizontally relative to the carriage member 144. The horizontal adjustment arrangement 136 also includes an adjustment screw 141 that is rotated about its longitudinal axis to adjust the horizontal position of the adjustment block 139 relative to the carriage member 144. The horizontal adjustment arrangement 136 further includes a set screw **140*a* (see FIG. 3) for locking the adjustment block 139 at a desired position relative to the carriage member 144. The desired position of the adjustment block 139 corresponds to a sight 50** position that adequately accounts for windage.

Figure 3:
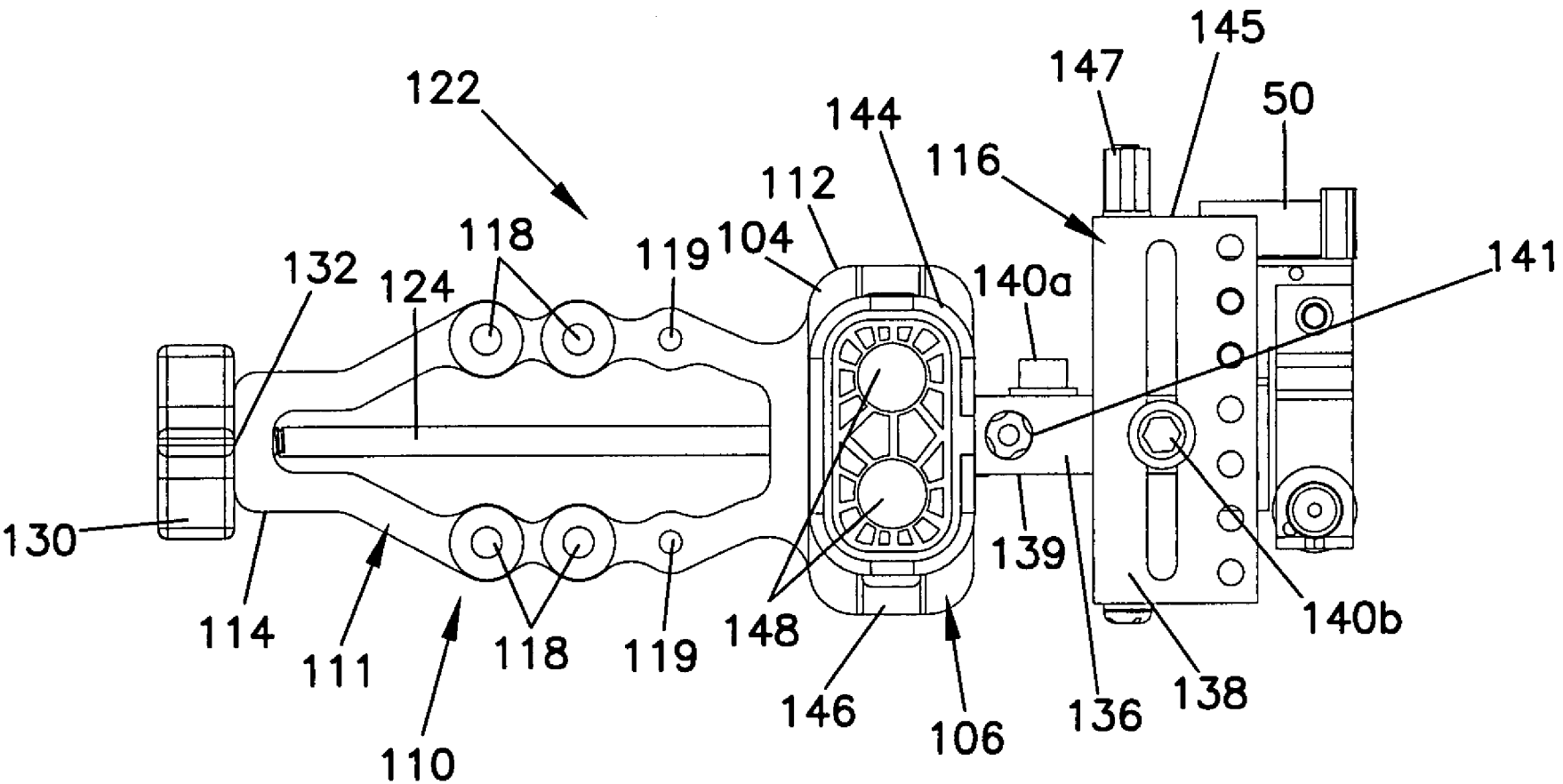
FIG. 3 is a side view of the bow sight assembly of FIG. 2.
Figure 4:
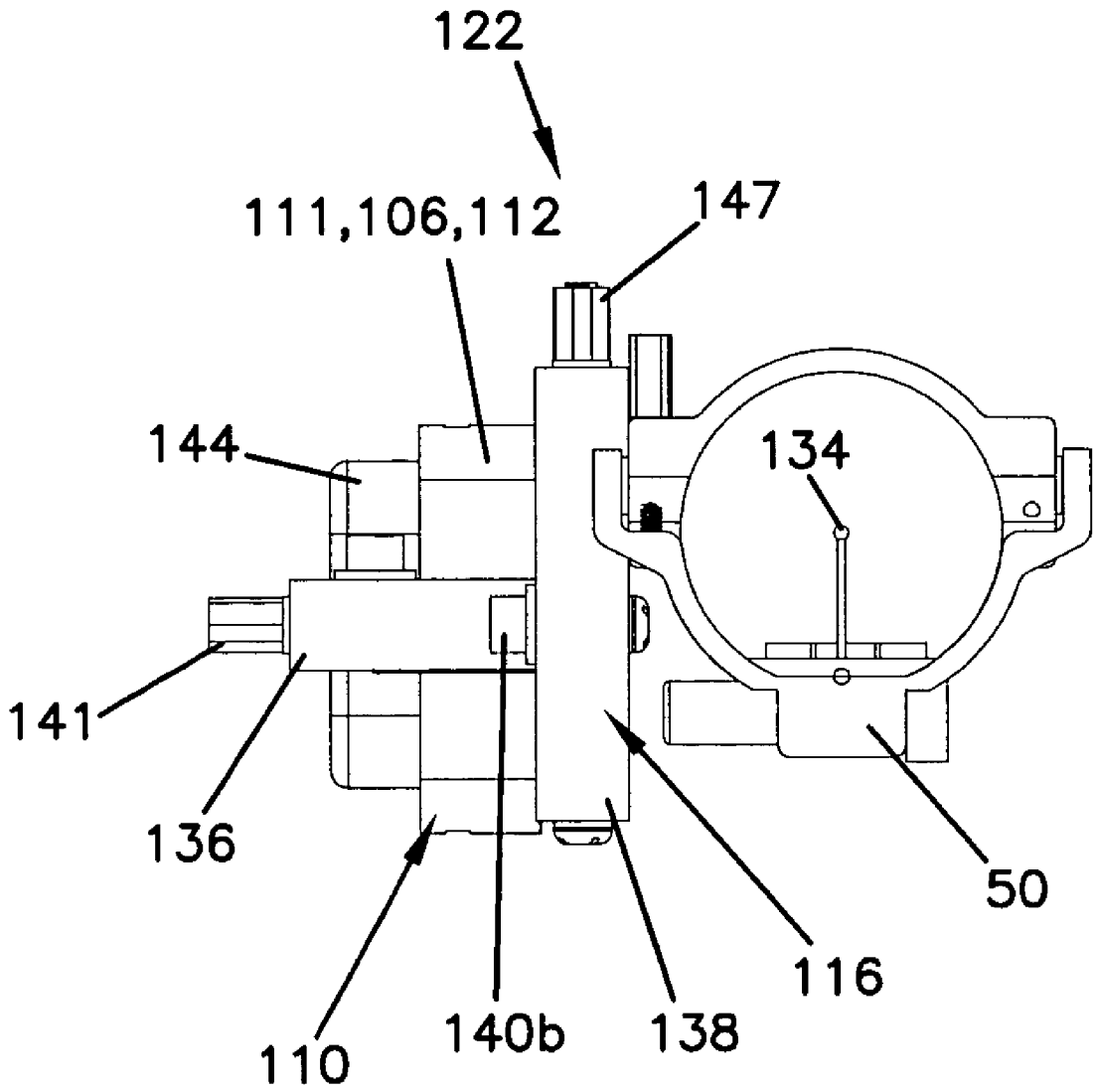
FIG. 4 is a front view of the bow sight assembly of FIG. 2.

As shown in FIG. 3, the vertical adjustment arrangement 138 includes a vertical adjustment member 145 mounted to slide vertically relative to the horizontal adjustment block 139. The vertical adjustment arrangement 138 also includes an adjustment screw 147 that is rotated about its longitudinal axis to adjust the vertical position of the vertical adjustment member 145 relative to the horizontal adjustment block 139. The vertical adjustment arrangement 138 further includes a set screw **140*b*** for locking the vertical adjustment member 145 at a desired position relative to the horizontal adjustment block 139. The desired position of the adjustment member 145 corresponds to a sight 50 position that is "zeroed-in" relative to the central support 111 and the carriage member 144.

The carriage member 144 of the bow sight mount 116 is connected to the first end 112 of the central support 111 by a slide linkage that allows the carriage member 144 to slide vertically relative to the central support 111. As shown in FIG. 5, the slide linkage is provided by an extension or dovetail 150 of the carriage member 144 that fits within a corresponding opening defined by the central support 111 such as dovetail slot 146. Cooperation of dovetail 150 and slot 146 provide a vertically adjustable connection between positioning mechanism 110 and bow sight mount 116, while inhibiting movement in other planes or directions. By allowing only vertical movement, the cooperation of dovetail 150 and slot 146 help preserve the windage position of bow sight 50 while permitting quick and easy elevation adjustment of sight 50 as desired for a particular shot. Other shapes of slots 146 and extensions 150 may be used provided they cooperate to preserve windage adjustment and permit adjustment of elevation of sight 50.

Referring to FIGS. 2 and 3, the drive shaft 124 of the positioning mechanism 110 is mounted to extend longitudinally through central support 111 between ends 112, 114. The shaft 124 includes a front end 126 to which a pinion gear 128 is mounted, and a rear end 130 to which the finger grip 132 is mounted. The pinion gear 128 forms part of the gear arrangement 106 for moving the sight 50 relative to the central support 111. Shaft 124 is rotatably mounted within central support 111 and pinion gear 128 and finger grip 132 are rotatably fixed to shaft 124. Rotation of the finger grip 132 causes rotation of pinion gear 128.

Figure 6:
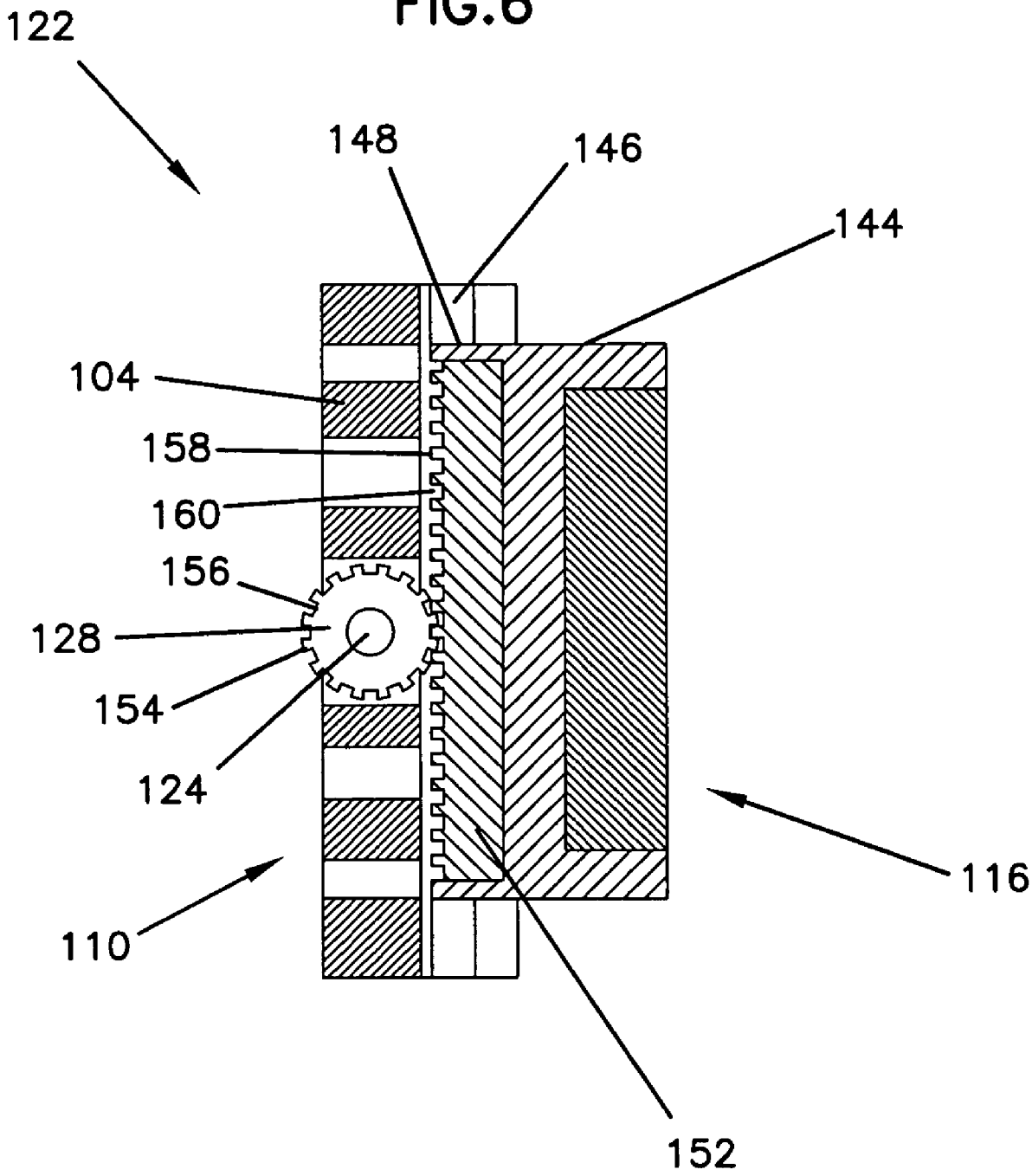
FIG. 6 is a cross-sectional view of the bow sight assembly of FIG. 2, taken along line 6-6 in FIG. 5.

In addition to the pinion gear 128, the gear arrangement 106 also includes an inner toothed surface or rack 152 (shown in FIG. 6) mounted to the carriage member 144. Adjustment of elevation of bow sight 50 is accomplished by the pinion gear 128 of the shaft 124 engaging the rack 152 of carriage member 144, as shown in FIG. 6. Pinion gear 128 includes a plurality of teeth 154 and recesses 156 between teeth 154. Teeth 154 and recesses 156 are equally spaced about a circumference of pinion gear 128. Rack 152 includes a plurality of teeth 158 with recesses 160 between teeth 158. Teeth 158 and recesses 160 are linearly arranged along a side of extension 150, which is received within slot 146 so that teeth 154 of gear 128 engage recesses 160 of rack 152. In this arrangement, rotation of finger grip 132 of shaft 124 rotates pinion gear 128 which in turn moves rack 152 and the rest of bow sight mount 116 in a vertical direction to adjust the elevation for a particular shot an archer wishes to make.

Shaft 124 is configured to rotate about a longitudinal axis which is oriented perpendicular to the vertical movement of bow sight mount 116. Rear end 130 of shaft 124 is oriented toward the archer when the archer is in a normal shooting position behind bow 10.

The first end 112 of the central support 111 includes a rearwardly facing reference strip 142, (shown in FIG. 2) that is readily visible to an archer using sight assembly 122. The reference strip 142 is used to determine the relative vertical position of the sight 50 relative to the support 111. The strip 142 is used in combination with a distance indictor pin 300 carried by the horizontal adjustment block 139 of the sight mount assembly 116. During the "sighting-in" (i.e., calibration) process, the archer may use the reference strip 142 to place marks 400*a*, 400*b*, 400*c* corresponding to different target distances. After the bow has been successfully sighted-in, the archer can accurately shoot at a target at a first distance by vertically moving the sight 50 until the pin 300 aligns with a mark corresponding to the first distance. The vertical positioning mechanism 100 permits rapid and accurate vertical adjustment of sight 50. Reference strip 142 also provides a rapid reference to permit movement of sight mount 116 to locations corresponding to different target distances.

Reference strip 142 may allow for easy erasure and placement of marks so that sight assembly 122 can be adapted for use with different bows, different styles and weights of arrows, and different atmospheric or weather conditions.

In use, adjustment arrangements 136 and 138 permit an archer to fine tune the location of sight 50 with respect to the archer's particular bow 10 and style of sighting and shooting. The horizontal adjustment arrangement 136 permits lateral adjustment of sight 50 to account for windage. The vertical adjustment arrangement 138 allows the sight assembly 122 to be "zeroed-in." To "zero-in" the sight assembly, the carriage member 144 can be centered relative to the gear 128, and the vertical adjustment arrangement 138 can be used to vertically move the sight 50 relative to the central support 111. If desired, the sight can be moved by the adjustment arrangement 138 to a vertical position corresponding to a standard mid-range shooting distance (e.g. 25 yards). When the sight 50 has been moved to a vertical position which results in the desired shot accuracy for the desired mid-range distance, the sight assembly has been "zeroed-in" and a mark 400*a* can be placed on the strip 142 corresponding to the set location of the pin 300. The vertical adjustment arrangement 138 is then preferably locked-down via the set screw 140*b*. Thereafter, the vertical positioning mechanism 100 is used to vertically move the sight 50 to establish mark locations 400*b*, 400*c* corresponding to shot distances greater and less than the mark 400*a*.

Because of the vibrations associated with shooting a bow, vibration dampening is desirable. To assist in dampening vibration, a pair of harmonic balancing devices 148 are mounted in the carriage member 144 to cancel out or compensate for some of the vibration generated and transmitted through the bow during the process of shooting an arrow. Alternatively, carriage element 144 may include no such devices, may include more or fewer balancing devices, or may include different accessories as may be desired by the archer.

The above specification and examples provide a complete description of the manufacture and use of the invention. It is to be understood that other embodiments may be utilized and structural changes may be made without departing from the present invention. Although a bow sight has been described, the details of this invention can be incorporated into other projecting shooting applications and systems, such as sights for rifles and shotguns. Since many embodiments of the invention can be made without departing from the spirit and scope of the invention, the invention resides in the claims hereinafter appended.

What is claimed is:

1. A vertical positioning apparatus for a bow sight, the apparatus comprising:

a central support with a first end, an opposing second end, and a bow mounting region between the first and the second end, the bow mounting region having fastener apertures for attaching the central support to a bow;

the second end of the central support including a pinion gear connected to a forward end of a sight adjustment shaft, the sight adjustment shaft having a rear end extending through the first end of the central support, wherein the sight adjustment shaft is rotatable mounted through the central support and wherein an adjustment knob for rotating the sight adjustment shaft is mounted to the rear end of the sight adjustment shaft adjacent the first end of the central support;

a bow sight mount movably mounted to the second end of the central support, the bow sight mount including a rack engaging the pinion gear, the bow sight mount movable in a vertical direction and constrained from movement in a horizontal direction with respect to the central support;

wherein rotation of the adjustment knob about a longitudinal axis perpendicular to the vertical movement of the bow sight mount rotates the pinion gear engaging the rack and moves the bow sight mount vertically with respect to the central support.

2. The vertical positioning apparatus of claim 1, further comprising a bow sight fixedly mounted to the bow sight mount and rotation of the shaft moves the bow sight vertically.

3. The vertical positioning apparatus of claim 2, wherein the bow sight includes a single sighting pin.

4. The vertical positioning apparatus of claim 1, wherein the rear end of the shaft includes a finger grip.

5. The vertical positioning apparatus of claim 4, wherein the finger grip is a four prong star shape.

6. The vertical positioning apparatus of claim 1, wherein the sight mount is mounted to the central support by a sliding dovetail.

7. A bow sight system comprising:

a bow sight including a sighting pin;

a sight mount to which the bow sight is mounted;

a support with a first end configured to mount to a bow and a second end opposite the first end, the first end including an upper portion and a lower portion and a slot between the upper portion and lower portion, wherein the upper and lower portion including a plurality of bow mounting locations thereon;

the sight mount vertically movably mounted to the second end of the support;

the sight mount including a rack and the support including a pinion gear, wherein rotation of the pinion gear will move the sight mount and the bow sight vertically with respect to the support; and a shaft with the pinion gear mounted to a front end and a rear end extending toward the first end of the support through the slot between the upper portion and lower portion, wherein rotation of the rear end of the shaft about a longitudinal axis moves the sight mount vertically.

8. The bow sight system of claim 7, wherein the bow sight includes a single sighting pin.

9. The bow sight system of claim 7, wherein the rear end of the shaft includes a finger grip.

10. The bow sight system of claim 9, wherein the finger grip is a four prong star shape.

11. The bow sight system of claim 7, wherein the sight mount is mounted to the central support by a sliding dovetail.

12. An apparatus for adjusting the vertical position of a bow sight relative to a bow, the apparatus comprising:

a support having a length that extends from a front end to a rear end, the support including a bow connection location positioned between the front and rear ends;

a sight carriage adapted for carrying the sight, the sight carriage being positioned adjacent the front end of the support;

a gear arrangement for moving the sight carriage up and down relative to the support, the gear arrangement including a rack and a drive gear, the rack being connected to the carriage so as to move up and down with the carriage; and a drive shaft rotatable mounted in the support having a longitudinal axis that extends along the length of the support, wherein rotation of the drive shaft in a first direction about its longitudinal axis causes the gear arrangement to move the sight carriage upwardly relative to the support, and rotation of the drive shaft in a second direction about its longitudinal axis causes the gear arrangement to move the sight carriage downwardly relative to the support;

wherein the drive shaft includes a front end and a rear end, wherein the front end of the drive shaft is connected to the drive gear and wherein the drive shaft extends through the rear end of the support such that the rear end of the drive shaft is positioned rearward of the rear end of the support.

13. The apparatus of claim 12, wherein the apparatus further includes a finger grip mounted to the rear end of the drive shaft positioned rearward of the support.

14. The apparatus of claim 12, further comprising a windage adjustment member carried by the sight carriage.

15. The apparatus of claim 12, wherein the connection location is located on a central region of the support, the central region having an upper bracket arm and a lower bracket arm, wherein the upper and lower bracket arms each including at least one mounting aperture, and wherein the drive shaft extends through an open space between the upper and lower bracket arms.

* * * * *

UNITED STATES PATENT AND TRADEMARK OFFICE

CERTIFICATE OF CORRECTION

PATENT NO. : 7,275,328 B1
APPLICATION NO. : 11/137116
DATED : October 2, 2007
INVENTOR(S) : Christopher A. Rager It is certified that error appears in the above-identified patent and that said Letters Patent is hereby corrected as shown below:

Column 7, line, 2, please change the word “rotatable” to --rotatably--

Column 8, line, 23, please change the word “rotatable” to --rotatably--

Signed and Sealed this

Twenty-seventh Day of November, 2007

JON W. DUDAS
*Director of the United States Patent and Trademark Office*